United States Patent [19]

Brück

[11] 4,024,746

[45] May 24, 1977

[54] STAND GEARING ARRANGEMENT FOR THE ROLLS OF A CONTINUOUS ROLLING MILL

[75] Inventor: Josef Brück, Duisburg, Germany

[73] Assignee: Demag Aktiengesellschaft, Germany

[22] Filed: Jan. 27, 1976

[21] Appl. No.: 652,875

[30] Foreign Application Priority Data

Jan. 28, 1975 Germany ..... 2503325

[52] U.S. Cl. ..... 72/249

[51] Int. Cl.[2] ..... B21B 35/02

[58] Field of Search ..... 72/249, 234, 235

[56] References Cited

UNITED STATES PATENTS 3,129,618 4/1964 Hergeth ..... 72/249 X

FOREIGN PATENTS OR APPLICATIONS 745,715 12/1944 Germany ..... 72/249

443,160 4/1927 Germany ..... 72/249

*Primary Examiner*—Milton S. Mehr

*Attorney, Agent, or Firm*—Mandeville and Schweitzer

[57] ABSTRACT

The invention involves individual gearing arrangements for the rolls of a stand of a continuous rolling mill, particularly for a wire manufacturing block with gears graduated from stand to stand in accordance with the degree of elongation to be secured in a sequence of working on wire rods.

3 Claims, 3 Drawing Figures

STAND GEARING ARRANGEMENT FOR THE ROLLS OF A CONTINUOUS ROLLING MILL

BACKGROUND OF THE INVENTION

It is known to manufacture wire, e.g. of 5 to 12 mm. in diameter, on a so-called wire manufacturing block which may incorporate 6, 8 or 10 stands positioned sequentially. The are usually arranged horizontally with the opposed rolls in each stand displaced 90° in engagement with the wire, so as to maintain the surfaces of the wire and the diameter even. Each stand is equipped with a drive gear, and all gears are connected to one common main gear shaft. The latter is driven, via an intermediate gear, by one motor only.

The gears are designed so that the number of revolutions of the wire engaging rolls for each stand is graduated in accordance with the required degree of elongation desired between the individual stands. Thus, the relationship between individual stands of the scale of the number of revolutions, as well as the elongation degree sequence for the wire block, are rigidly determined and can be altered only by reconstruction of the gear transmission stages. Such reconstruction, however, can be done only during shutdown of the line, and only with great expenditure. Moreover, if the final diameter of the wire rod is to be comparatively large, the rigidly determined elongation degree sequence requires that a large tap or initial diameter be chosen. This, however, requires very high rolling pressures, and even greater rolling momentum. Provisions have been made to obtain the desired large final diameter by bypassing several stands. This makes it possible to tap with a smaller diameter, while maintaining the predetermined elongation degree sequence. However, this solution has the disadvantage of inferior dimensional integrity of the final diameter on account of the residual errors, as these are directly affected by the number of stands in operation engaging the wire.

Another suggestion is to utilize continually controllable gears, such as hydraulic or summation transmissions, to obtain differential elongation degrees. Hydraulic transmissions or other similarly functioning transmissions have the decided disadvantage, however, of allowing slippage in the number of revolutions of the rolls engaging the wire, which cannot be tolerated in continuous rolling mills. Furthermore, the known transmissions have the decided disadvantage that adjustment of velocity stages is very complicated, and therefore causes errors, and these adjustments must be carried out during shutdown of the line.

STATEMENT OF THE INVENTION

Based on these problems, it is the object of the present invention to improve upon a group transmission for the line of a rolling mill with simple means where optimum tolerances and integrity of the rolled material are obtained even with the use of a large number of stands, and without considerably increasing rolling pressure or momentum and guaranteeing the use of the continuous rolling mill even for widely varying dimensions. To achieve this, the invention utilizes for each stand, a gear arrangement which may be switched to at least two different velocity stages to form several elongation degree sequences in the rolling mill.

This solution represents a favorable way of increasing the tolerance of the diameter, as there are at least two exactly graduated elongation degree sequences in a line in order to roll varying diameters with the greatest possible number of stands. This also increases the final velocity of the largest diameter to be rolled which is advantageous with respect to production. With the proper graduation of elongation degree sequences, it is also possible with this invention to switch from one elongation degree sequence into the other at individual stands in order to handle materials which are difficult to roll. The continuous rolling mill and/or the wire manufacturing block of the invention is thus more flexible.

In accordance with the invention, each stand is equipped, at the connection with the main drive, with at least two separate hollow shafts coaxially encompassing the main transmission shaft, and the hollow shafts are arranged to be connected to or disconnected from the main shaft. Each hollow shaft bears a fixed pinion, and each pinion engages a fixed pinion arranged on a bevel gear shaft parallel with the main transmission shaft, so that each pinion pair provides the differential gear ratios.

Another embodiment of the invention is arranged with two intermediate shafts common to each stand sequence, with such intermediate shafts being parallel to one another as well as to the main transmission shaft. The intermediate shafts are connected to the main transmission shaft via alternately connected or disconnected power-branching pinion gears, whereby each intermediate shaft forms one of the velocity stages of the rolling mill via bevel gear pairs.

With the foregoing objects in view, this invention will now be described in more detail, and other objects and advantages thereof will be apparent from the following description, the accompanying drawings, and the appended claims.

DETAILED DESCRIPTIGN OF THE INVENTION

Figure 1:
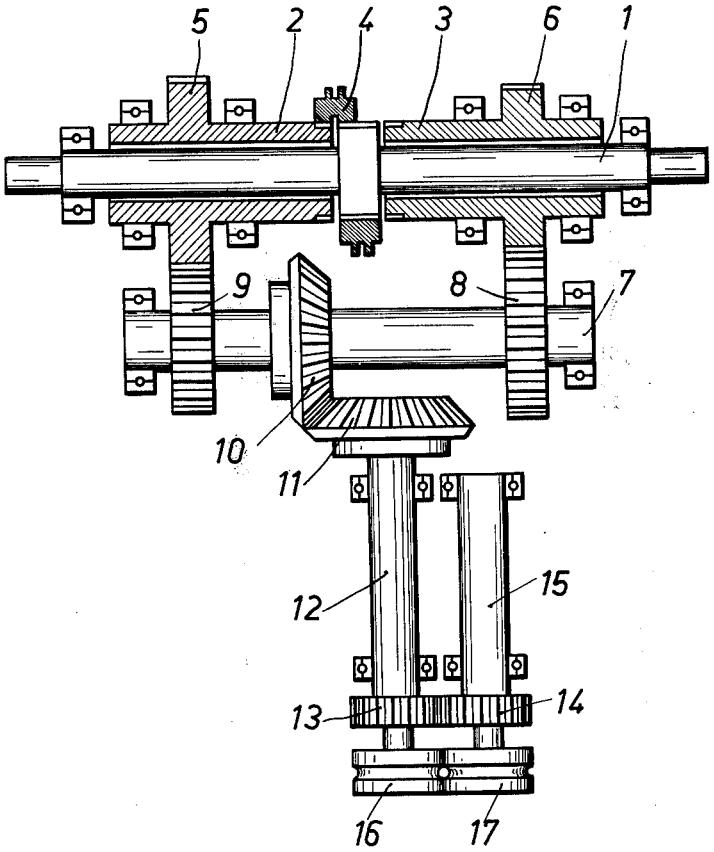
FIG. 1 is a schematic illustration of a gear transmission arrangement for a stand in a rolling mill line embodying principles of the invention.

Referring to drawings, in which like reference numbers refer to like parts throughout the several views thereof, in FIG. 1, 1 represents the main transmission drive shaft which is driven by a motor via an intermediate gear in known manner, and both of which are not shown here. Main transmission shaft 1 is encompassed by two hollow shafts 2 and 3. Pinions 5 and 6 are fixed on hollow shafts 2 and 3, respectively. Hollow shafts 2 and 3 are connected to or disconnected from main transmission shaft 1 via displacement clutch 4. Parallel with main transmission shaft 1 is bevel gear shaft 7, onto which is mounted fixed bevel gear 10. Also, pinions 8 and 9 are fixedly mounted on bevel gear shaft 7, whereby pinion 8 engages pinion 6 arranged on hollow shaft 3, and pinion 9 engages pinion 5 on hollow shaft 2. Differential gear ratios exist between gear pairs 5 and 9, and 6 and 8.

Bevel gear 10 engages bevel gear 11 arranged cantilevered or flying on shaft 12. Shaft 12 has on its opposite end pinion 13 which engages pinion 14, which is of the same size, and which is also arranged cantilevered or flying on shaft 15. Pinions 14 and 15 endure synchronism of rollers 16 and 17, which engage the wire and are arranged cantilevered on shafts 12 and 15. Depending upon the position of clutch 4, the power of the transmission runs either from main transmission shaft 1 via clutch 4 onto hollow shaft 2, and from there via pinions 5 and 9 to bevel gears 10 and 11, and via shaft 12 to pinions 13 and 14 which drive rollers 16, 17; or, according to the drawing, if the clutch 4 is in right-hand position, from main transmission shaft 1 via clutch 4 onto hollow shaft 3, via gear pair 6, 8 to bevel gear 10, and from there in the above-described manner toward pinions 13, 14.

Figure 2:
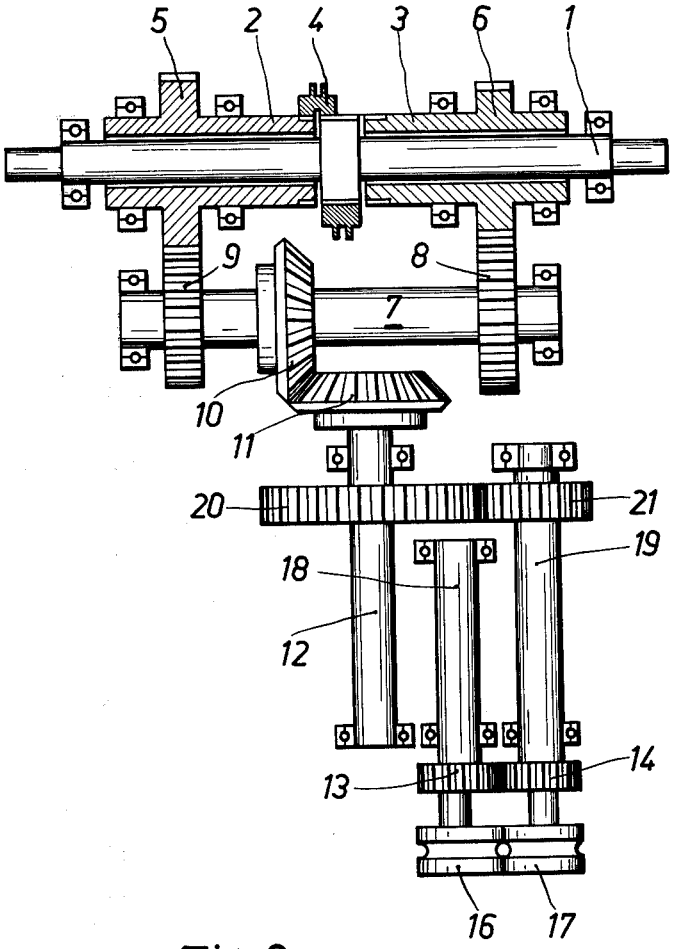
FIG. 2 is a schematic illustration of the gear transmission of FIG. 1, modified to include an additional gear stage.

The example shown in FIG. 2 is similar to FIG. 1 but has a supplementary transmission stage. Up to bevel gear 11, the power flow of the transmission is the same as described in the example according to FIG. 1, either via the transmission stage of the gear pair 5, 9 or gear pair 6, 8. Bevel gear 11 is arranged fixed on intermediate shaft 12, which also carries fixed pinion 20. Pinion 20 engages pinion 21 on shaft 19, which, via pinion 14, drives pinion 13 arranged on shaft 18 just the same as pinion 14.

Rollers 16, 17 are arranged on the end of the shafts 18 and 19 facing away from the transmission. Gear pair 13, 14 maintains synchronism of rollers 16, 17. Gear pair 20, 21 increases the speed ratio from the number of revolutions.

Figure 3:
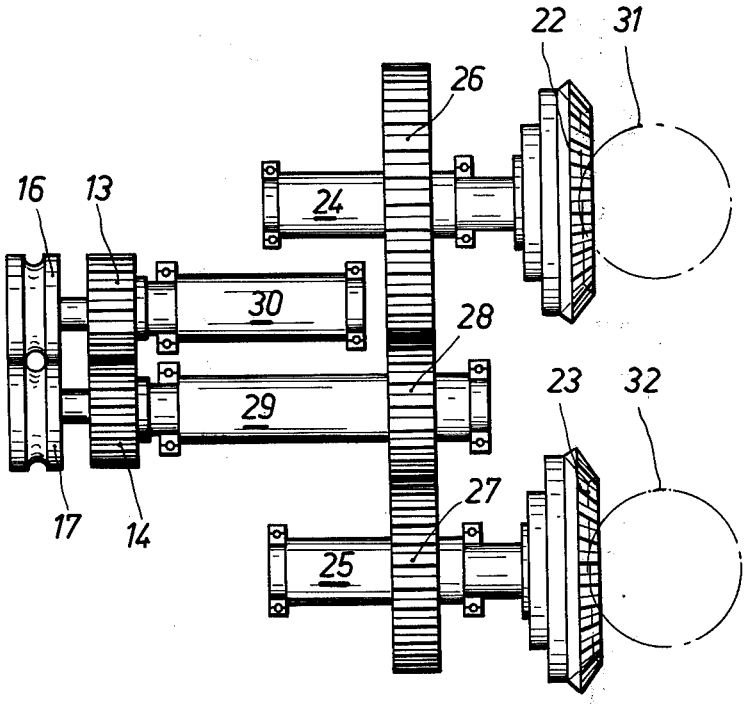
FIG. 3 is a further embodiment of a gear transmission arrangement for a stand and embodying principles of the invention.

FIG. 3 shows another transmission embodiment. The main transmission shaft (not shown) branches into two intermediate shafts 31, 32 shown diagrammatically, which can be connected to or disconnected from the main transmission shaft. Intermediate shafts 31, 32 gear via bevel gears, not shown, with bevel gears 22 and 23 which are arranged cantilevered or flying on shafts 24 and 25. Shafts 24 and 25 each carry one pinion 26 and 27 which engage a further pinion 28. Differential gear ratios exist between pinions 26 and 28, and pinions 27 and 28. Pinion 28 is non-rotatable on shaft 29, which is also located pinion 14. Pinion 14 engages pinion 13 on shaft 30 and maintains, as described in the previous examples, the synchronism of rollers 16, 17. Depending upon connection of intermediate shafts 31, 32, the power flow of the transmission runs either via intermediate shaft 31 on bevel gear 22, from there via pinion pair 26, 28 to pinion 14 or, when connecting intermediate shaft 32, via bevel gear 23 and gear pair 27, 28, also towards pinion 14. As either intermediate shaft 31 or 32 is always disconnected from the main transmission shaft, pinion pair 26, 28 or 27, 28 opposite the drive runs in neutral.

While the arrangements of apparatus herein disclosed form preferred embodiments of the invention, this invention is not limited to those specific arrangements of apparatus, and changes can be made therein without departing from the scope of the invention which is defined in the appended claims.

I claim:

1. A transmission arrangement for the rollers of the individual stands in a continuous rolling mill line, particularly for wire manufacturing in which the gears of each stand in the line are graduated according to the desired degree of elongation required of the wire rod, said transmission arrangement comprising a. a common transmission drive shaft connected to a power source;

b. a plurality of stands in the line with each connected to said common transmission drive shaft;

c. a set of opposed wire engaging rolls in each stand connected to said common transmission drive shaft by a stand gearing arrangement; the improvement characterized by d. each stand gearing arrangement including selectively at least two gear connection paths between said main transmission shaft and said rolls;

e. each said gear connection path providing a fixed connection to its respective rolls; and f. said gear connection paths providing different speed ratios between said main transmission shaft and said rolls.

2. The apparatus of claim 1, further characterized by each of gear connection paths including a. an intermediate shaft;

b. said intermediate shaft being parallel to said intermediate shafts in said other gear connection paths and to said main shaft, c. a bevel gear engaging said intermediate shaft;

d. a bevel gear shaft with said bevel gear disposed at one end thereof;

e. a first pinion fixed on said bevel gear shaft;

f. an output shaft; and g. a second pinion fixed on said output shaft and in engagement with first pinion;

h. said engaged pair of pinions defining one of said gear connection paths.

3. A transmission arrangement for the rollers of the individual stands in a continuous rolling mill line, particularly for wire manufacturing in which the gears of each stand in the line are graduated according to the desired degree of elongation required of the wire rod, said transmission arrangement comprising a. a common transmission drive shaft connected to a power source;

b. a plurality of stands in the line with each connected to said common transmission drive shaft;

c. a set of opposed wire engaging rolls in each stand connected to said common transmission drive shaft by a stand gearing arrangement; the improvement characterized by d. each stand gearing arrangement including selectively at least two gear connection paths between said main transmission shaft and said rolls;

e. each of said gear connection paths including 1. a hollow shaft coaxially surrounding said main transmission shaft with clutch means between the two;

2. a pinion gear fixed on said hollow shaft;

3. a bevel gear shaft parallel with said main shaft;

4. a second pinion gear fixed on said bevel gear shaft; and 5. said second pinion gear on said bevel gear shaft engaging said pinion on said hollow shaft;

6. said engaged pair of pinion gears defining one of said gear connection paths; and f. said gear connection paths providing different speed ratios between said main transmission shaft and said rolls.

* * * * *